US011022141B2

(12) United States Patent
Hayamitsu et al.

(10) Patent No.: US 11,022,141 B2
(45) Date of Patent: Jun. 1, 2021

(54) FAN ASSEMBLY

(71) Applicant: Nidec Corporation, Kyoto (JP)

(72) Inventors: Ryosuke Hayamitsu, Kyoto (JP); Atsushi Michishita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 552 days.

(21) Appl. No.: 15/578,723

(22) PCT Filed: Apr. 6, 2016

(86) PCT No.: PCT/JP2016/061207

§ 371 (c)(1),
(2) Date: Dec. 1, 2017

(87) PCT Pub. No.: WO2016/199487

PCT Pub. Date: Dec. 15, 2016

(65) Prior Publication Data

US 2018/0163748 A1 Jun. 14, 2018

Related U.S. Application Data

(60) Provisional application No. 62/172,418, filed on Jun. 8, 2015.

(51) Int. Cl.

| | |
|---|---|
| ***F04D 29/44*** | (2006.01) |
| ***F25D 17/06*** | (2006.01) |
| ***F25D 17/08*** | (2006.01) |

(52) U.S. Cl.

CPC ..... *F04D 29/444* (2013.01); *F25D 17/062* (2013.01); *F25D 17/08* (2013.01);
(Continued)

(58) Field of Classification Search
None
See application file for complete search history.

(56) References Cited

U.S. PATENT DOCUMENTS 1,616,566 A * 2/1927 Barker ..... B02C 17/18 209/143
7,718,136 B2 * 5/2010 Ohtsuka ..... F25D 17/042 422/120

(Continued)

FOREIGN PATENT DOCUMENTS

JP 2002-031465 A 1/2002
JP 2004-101088 A 4/2004

(Continued)

OTHER PUBLICATIONS

Official Communication issued in International Patent Application No. PCT/JP2016/061207, dated Jul. 5, 2016.

*Primary Examiner* — David Hamaoui
*Assistant Examiner* — Jason Fountain
(74) *Attorney, Agent, or Firm* — Keating & Bennett

(57) ABSTRACT

A fan assembly for a refrigerator interior includes a lower housing where a fan that rotates around a rotation axis as a center is installed, the rotation axis extending in an up-down direction; an upper housing that includes an inlet that sucks air from the refrigerator interior; and a side housing that covers a surrounding portion of the fan, wherein any one of the upper housing, the lower housing, and the side housing includes a flow straightening member that straightens a flow of air that is discharged from the fan, and wherein any one of the upper housing, the lower housing, and the side housing includes a discharge port.

19 Claims, 9 Drawing Sheets

(52) U.S. Cl.
CPC .. *F25D 2317/063* (2013.01); *F25D 2317/067* (2013.01); *F25D 2317/0683* (2013.01)

(56) References Cited

U.S. PATENT DOCUMENTS

| | | | | |
|---|---|---|---|---|
| 10,077,784 | B2 * | 9/2018 | Schulze | H05K 7/20172 |
| 10,254,035 | B2 * | 4/2019 | Yun | F25D 23/12 |
| 2006/0263280 | A1 * | 11/2006 | Ohtsuka | F25D 17/042 422/291 |
| 2009/0324403 | A1 * | 12/2009 | Zheng | F04D 25/0613 415/203 |
| 2010/0071875 | A1 * | 3/2010 | Hwang | G06F 1/203 165/80.3 |
| 2012/0272670 | A1 * | 11/2012 | Choi | F25D 23/069 62/89 |
| 2016/0146218 | A1 * | 5/2016 | Schulze | F04D 25/08 415/1 |
| 2017/0234598 | A1 * | 8/2017 | Yun | F25D 23/12 96/397 |
| 2019/0310007 | A1 * | 10/2019 | Li | F25D 17/065 |

FOREIGN PATENT DOCUMENTS

| | | | |
|---|---|---|---|
| JP | 2005-83652 | A | 3/2005 |
| JP | 2005-337118 | A | 12/2005 |

* cited by examiner

FAN ASSEMBLY

BACKGROUND OF THE INVENTION

1. Field of the Invention

The present invention relates to a fan assembly.

2. Description of the Related Art

A cooling fan that discharges air for cooling the inside of a refrigerator is installed in the refrigerator. For example, Japanese Laid-open Patent Application Publication 2004-101088 exists. Japanese Laid-open Patent Application Publication 2004-101088 discloses a refrigerator in which thought is put into the disposition of the cooling fan and the form of a fan casing in which the cooling fan is installed, and noise caused by the existence of a space whose pressure is locally high is reduced.

However, the sizes of fan assemblies in which a fan is installed vary for refrigerators, and in recent market trends, there is a further increasing demand for a reduction in noise.

An object of the present invention is to provide a new structure that can reduce noise in a refrigerator by using a flow straightening member provided in a fan assembly in which a fan is installed.

SUMMARY OF THE INVENTION

An exemplary embodiment of the present invention is a fan assembly for a refrigerator interior and includes a lower housing where a fan that rotates around a rotation axis as a center is installed, the rotation axis extending in an up-down direction; an upper housing that includes an inlet that sucks air from the refrigerator interior; and a side housing that covers a surrounding portion of the fan, wherein any one of the upper housing, the lower housing, and the side housing includes a flow straightening member that straightens a flow of air that is discharged from the fan, and wherein any one of the upper housing, the lower housing, and the side housing includes a discharge port.

According to the exemplary embodiment of the present disclosure, noise is reduced by increasing the blowing efficiency in the inside of the fan assembly as a result of designing the flow straightening member as appropriate in the fan assembly.

The above and other elements, features, steps, characteristics and advantages of the present discloser will become more apparent from the following detailed description of the preferred embodiments with reference to the attached drawings.

DETAILED DESCRIPTION OF THE PREFERRED EMBODIMENTS

In the present description, a direction parallel to a rotation axis of a fan is simply called "axial direction", a radial direction around the rotation axis as a center is simply called "radial direction", and a peripheral direction around the rotation axis as the center is simply called "peripheral direction". A direction in which a fan 21 is disposed is called "upstream side", and a direction in which air is discharged from the fan 21 is called "downstream side". However, the definitions of these directions are not intended to limit the orientation of a fan assembly that is installed in a refrigerator.

Figure 1:
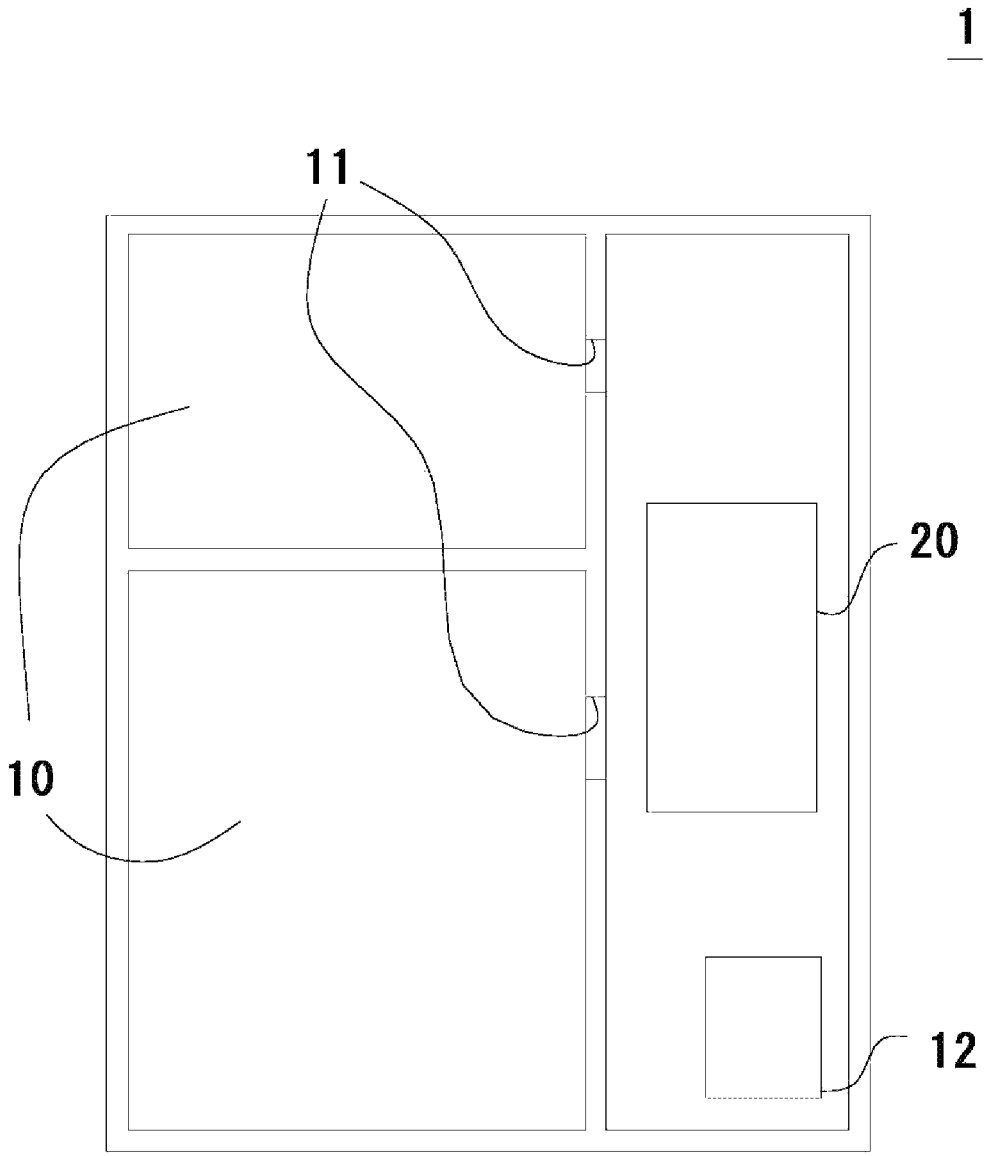
FIG. 1 is a conceptual view of a refrigerator including a fan assembly of a first embodiment.

FIG. 1 is a conceptual view of a refrigerator 1 including a fan assembly 20 according to an exemplary embodiment of embodiments. The refrigerator 1 includes a refrigerator interior 10, the fan assembly 20, and a cooling device 12. Air that has been cooled by the cooling device 12 passes through refrigerator interior through holes 11 via the fan assembly 20, and is guided to the refrigerator interior 10.

Figure 2:
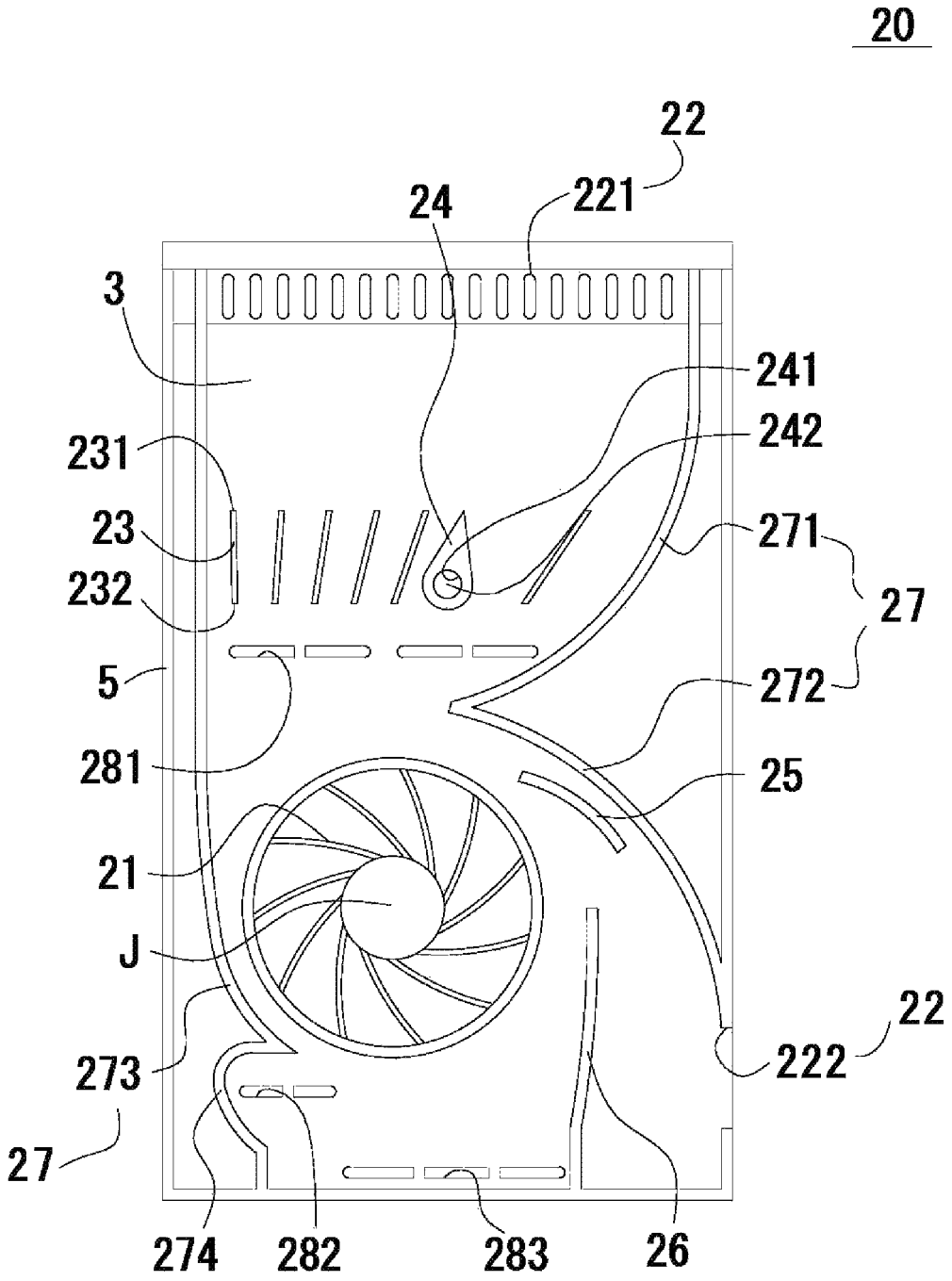
FIG. 2 is a cross sectional view of the fan assembly of the first embodiment.
Figure 3:
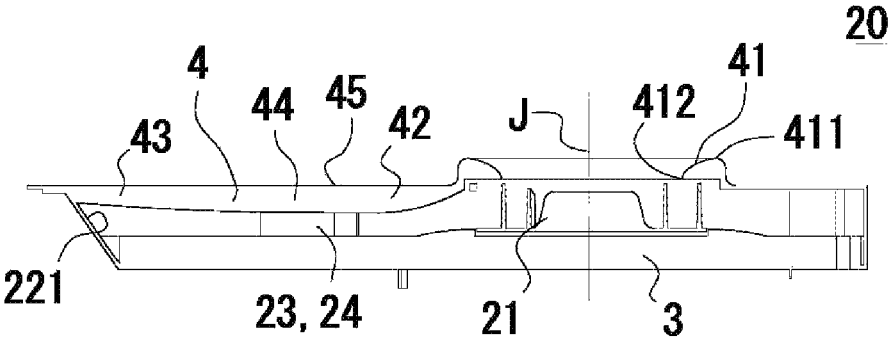
FIG. 3 is a vertical sectional view of the fan assembly of the first embodiment.

FIG. 2 is a cross sectional view of the fan assembly 20 of an exemplary first embodiment of the present disclosure. FIG. 3 is a vertical sectional view of the fan assembly 20 of the exemplary first embodiment of the present disclosure. In the embodiment, the fan assembly 20 includes the fan 21 that rotates around a rotation axis J as a center, and a plurality of discharge ports 22. The fan 21 is desirably a so-called centrifugal blower, but may be, for example, an axial flow fan or a diagonal flow fan.

The fan assembly 20 includes a lower housing 3 where the fan 21 that rotates around the rotation axis J as the center is installed, the rotation axis J extending in an up-down direction; an upper housing 4 that includes an inlet 41 that sucks air into the fan assembly 20 from the refrigerator interior 10; and a side housing 5 that covers a surround portion of the fan 21.

Any one of the upper housing 4, the lower housing 3, and the side housing 5 includes a flow straightening member that straightens the flow of air that is discharged from the fan 21. Any one of the upper housing 4, the lower housing 3, and the side housing 5 includes the plurality of discharge ports 22 and a plurality of ventilation ports 28 (281, 282, 283) that discharge air to the outside of the fan assembly 20. The flow straightening member includes a first flow straightening portion that is provided at the lower housing 3, a second flow straightening portion that is provided at the upper housing 4, and a third flow straightening portion that is provided at the side housing 5. However, the lower housing 3, the upper housing 4, and the side housing 5 need not be separate members. For example, the lower housing 3 and the side housing 5 may partly be a single member, or the side housing 5 and the upper housing 4 may partly be a single member.

The first flow straightening portion includes at least one of a plurality of first flow straightening plates 23, a coupling portion 24, and a guiding portion 25. The plurality of first flow straightening plates 23, the coupling portion 24, and the guiding portion 25 are members extending in the axial direction from the lower housing 3. The third flow straightening portion includes a partition plate 26 and guide walls 27. The partition plate 26 and the guide walls 27 are parts of the side housing 5. The plurality of first flow straightening plates 23, the coupling portion 24, the guiding portion 25, the partition plate 26, and the guide walls 27 desirably couple the lower housing 3 and the upper housing 4.

However, part of the first flow straightening portion may be provided at the upper housing 4 or the side housing 5. For example, any one of the plurality of flow straightening plates 23, the coupling portion 24, and the guiding portion 25 may be provided at the upper housing 4, and any one of the partition plate 26 and the guide walls 27 may be provided at the lower housing 3 or the upper housing 4. The plurality of discharge ports 22 may be provided in any of the lower housing 3, the upper housing 4, and the side housing 5. In FIG. 2, the discharge ports 22 include a plurality of first discharge ports 221 that are disposed above the fan 21, and a second discharge port 222 that is disposed below the fan 21.

The second flow straightening portion includes at least one of a first curved portion, a second curved portion, and a connecting portion, which are described later.

The first flow straightening portion is in detail described below. First, in FIG. 2, the plurality of first flow straightening plates 23, the coupling portion 24, the plurality of first discharge ports 221, and the plurality of first ventilation ports 281 are formed above the fan 21. At a portion between the fan 21 and the plurality of first discharge ports 221, the plurality of first flow straightening plates 23 extend from the upstream side, where the fan 21 is disposed, towards the downstream side, where the plurality of first discharge ports 221 are disposed. The plurality of first flow straightening plates 23 each include an upstream side end portion 231 and a downstream side end portion 232. The plurality of first flow straightening plates 23 that are adjacent to each other are spaced apart from each other with gaps therebetween. Gaps between the upstream side end portions 232 that are adjacent to each other are smaller than gaps between the downstream side end portions 231 that are adjacent to each other. That is, the widths of the gaps between the first flow straightening plates 23 that are adjacent to each other increase towards the downstream side, where the plurality of first discharge ports 221 are disposed, from the upstream side, where the fan 21 is disposed.

This causes the air volume characteristics to improve, the blowing efficiency in the inside of the fan assembly 20 to increase, and the cooling efficiency of the refrigerator 1 to increase. Since the widths of the gaps between the first flow straightening plates 23 that are adjacent to each other become larger, it is possible to suppress an increase in the pressures in the gaps and also to reduce noise.

At a portion between the fan 21 and the plurality of first flow straightening plates 23, the plurality of first ventilation ports 281 are formed. The plurality of first ventilation ports 281 are through holes provided in the lower housing 3 and extending therethrough in the axial direction. Part of air discharged from the fan 21 passes through the plurality of first ventilation ports 281, and is discharged to the outside of the fan assembly 20.

The plurality of first discharge ports 221 are through holes having a longitudinal direction in the axial direction. Part of the air discharged from the fan 21 passes through the gaps between the plurality of first flow straightening plates 23 that are adjacent to each other and gaps between the plurality of first flow straightening plates 23 and the coupling portion 24 (described later), and flows towards the plurality of first discharge ports 221, and is discharged to the outside of the fan assembly 20 via the plurality of first discharge ports 221.

In FIG. 2, the plurality of second ventilation ports 282 and the plurality of third ventilation ports 283 are formed below the fan 21. The plurality of second ventilation ports 282 and the plurality of third ventilation ports 283 are through holes that are formed in the lower housing 3 and that extend therethrough in the axial direction. Part of the air discharged from the fan 21 passes through the plurality of second ventilation ports 282 and the third ventilation ports 283, and is discharged to the outside of the fan assembly 20.

An inner surface of the fan assembly 20 includes a plurality of guide walls 27. The plurality of guide walls 27 include at least one of a first guide wall 271, a second guide wall 272, a third guide wall 273, and a fourth guide wall 274. In FIG. 2, the first guide wall 271 is disposed in a region on the upper right of the fan 21. Part of the air discharged from the fan 21 passes between the rightmost first flow straightening plate 23 in FIG. 2 among the plurality of first flow straightening plates 23 and the plurality of first guide walls 271, and flows towards the plurality of first discharge ports 221.

In this way, when part of the air moving towards the plurality of first discharge ports 221 from the fan 21 flows along the first guide wall 271, the occurrence of turbulence is reduced, so that the blowing efficiency is increased, and noise that is produced in the inside of the fan assembly 20 is also reduced.

In FIG. 2, the guiding portion 25, the second guide wall 272, and the second discharge port 222 are formed in a region on the right of the fan 21. Part of the air discharged from the fan 21 flows towards the second guide wall 272, is guided along the second guide wall 272 to the second discharge port 222, and is discharged to the outside of the fan assembly 20 from the second discharge port 222.

The guiding portion 25 is provided between the fan 21 and the second guide wall 272. Part of the air discharged from the fan 21 flows along a surface of the guiding portion 25 that is near the fan 21, and is guided towards the second discharge port 222. Therefore, compared to a case in which the guiding portion 25 is not provided, the air discharged from the fan 21 can be more efficiently guided towards the second discharge port 222. Part of the air discharged from the fan 21 is guided to the second discharge port 222 without the occurrence of turbulence, so that the blowing efficiency in the inside of the fan assembly 20 is increased and noise that is produced in the inside of the fan assembly 20 is reduced.

In FIG. 2, the partition plate 26 is provided below the guiding portion 25. The partition plate 26 separates air that is guided to the second discharge port 222 by the guiding portion 25 and the second guide wall 272 and air that flows towards the plurality of third ventilation ports 283 that are adjacent to the partition plate 26. That is, by disposing the partition plate 26, a channel for the air moving towards the second discharge port 222 and a channel for the air moving towards the third ventilation ports 283 are formed.

The third guide wall 273 is provided in a region on the left of the fan 21. Part of the air discharged from the fan 21 flows along the third guide wall 273, passes between the leftmost first flow straightening plate 23 in FIG. 2 among the plurality of first flow straightening plates 23 and the third guide wall 273, and is guided to the plurality of first discharge ports 221. Therefore, the blowing efficiency in the inside of the fan assembly 20 is increased and noise that is produced in the inside of the fan assembly 20 is reduced.

In FIG. 2, the fourth guide wall 274 and the plurality of ventilation ports 282 that are adjacent to the fourth guide wall 274 are formed in a region on the lower left of the fan 21. Therefore, part of the air discharged from the fan 21 flows along the fourth guide wall 274 and is efficiently guided to the plurality of second ventilation ports 282.

In FIG. 2, the coupling portion 24 is formed above the fan 21 at the lower housing 3. The coupling portion 24 is adjacent to the plurality of first flow straightening plates 23. That is, the distance from the rotation axis J to a particular first flow straightening plate 23 and the distance from the rotation axis J to the coupling portion 24 are substantially the same.

FIG. 3 is a vertical sectional view of the fan assembly 20 of the exemplary first embodiment of the present disclosure. The upper housing 4 includes the inlet 41, a first curved portion 42, a second curved portion 43, and a connecting portion 44. In the upper housing 4, the inlet 41 is formed above the fan 21 in the axial direction, and opens in a substantially circular shape around the rotation axis J as the center. Part of air that exists above the upper housing 4 in the axial direction passes through the inlet 41 and is sucked by the fan 21, and, in the inside of the fan assembly 20, is discharged from the upstream side to the downward side. In the embodiment, the air discharged from the fan 21 includes a swirling component that swirls around the rotation axis J as the center due to the rotation of the fan 21.

An inlet upper end 411 and an inlet lower end 412 are smoothly connected to each other. More specifically, the inlet upper end 411 and the inlet lower end 412 are connected to each other at a curved surface such that the opening diameter of the inlet 41 is gradually decreased towards a lower side in the axial direction from the inlet upper end 411. The curved surface has a shape whose upper side in the axial direction and inner side in the radial direction widen. The curved surface desirably has a catenary curve. This causes the flow of air sucked in from the inlet 41 to be efficiently guided to the fan 21 without being hampered. Therefore, the blowing efficiency of the fan 21 is increased, as a result of which the blowing efficiency in the inside of the fan assembly 20 is increased, and the cooling efficiency of the refrigerator 1 is increased. The curved surface may have other shapes. For example, the curved surface may have a shape that is substantially the same as part of an ellipse, or a shape that is substantially the same as part of a parabola.

An upper surface of the upper housing 4 has a planar surface 45 extending in a direction substantially orthogonal to the rotation axis J. The inlet lower end 412 is disposed above the planar surface 45 in the axial direction. In the inside of the fan assembly 20, a space in which the fan 21 is disposed can be made wide, and even the large fan 21 whose dimension in the axial direction is large can be installed.

The second flow straightening portion is hereunder described in detail. As mentioned above, the upper housing 4 includes the second flow straightening portion. The second flow straightening portion includes the first curved portion 42, the second curved portion 43, and the connecting portion 44, which protrude downward in the axial direction from a lower surface of the upper housing 4. The first curved portion 42 is disposed on an outer side of the inlet lower end 412 in the radial direction, and the second curved portion 43 is disposed on an outer side of the first curved portion 42 in the radial direction. The first curved portion 42 is a portion whose thickness in the axial direction increases from the upstream side, where the fan 21 is disposed, towards the downstream side, where the discharge ports 221 are disposed. The second curved portion 43 is a portion whose thickness in the axial direction decreases from the upstream side towards the downstream side at a location that is situated closer to the downstream side than the first curved portion 42.

On the other hand, an upper surface of the lower housing 3 has a planar surface extending in a direction substantially orthogonal to the axial direction. Therefore, at a region in the radial direction where the first curved portion 42 is formed, the size of a gap in the axial direction between the upper surface of the lower housing 3 and the lower surface of the upper housing 4 becomes smaller towards the outer side from the inner side in the radial direction, and static pressure is increased. That is, air that flows in the gap flows smoothly along the upper surface of the lower housing 3 and the lower surface of the upper housing 4 without being separated from the upper surface of the lower housing 3 and the lower surface of the upper housing 4. This reduces the occurrence of turbulence in the inside of the fan assembly 20, and increases the blowing efficiency in the inside of the fan assembly 20.

The first curved portion 42 may extend outward in the radial direction from the inlet lower end 412. That is, the first curved portion 42 may extend from the inlet lower end 412 towards the downstream side, where the discharge ports 221 are disposed. This can reduce the occurrence of turbulence below the inlet lower end 412.

At a region in the radial direction where the second curved portion 43 is formed, the size of the gap in the axial direction between the upper surface of the lower housing 3 and the lower surface of the upper housing 4 becomes larger towards the outer side from the inner side in the radial direction, and the resistance force that the air receives is reduced. That is, a reduction in the air flow speed is reduced. Consequently, the air discharged from the fan 21 flows smoothly towards the outer side in the radial direction, and the blowing efficiency in the inside of the fan assembly 20 is increased.

The outer side of the first curved portion 42 in the radial direction and an inner side of the second curved portion 43 in the radial direction are smoothly connected to each other by the connecting portion 44. The connecting portion 44 is a portion in which the thickness of the upper housing 4 in the axial direction is substantially constant regardless of the disposition in the radial direction. That is, at a region in the radial direction where the connecting portion 44 is disposed, the gap in the axial direction between the upper surface of the lower housing 3 and the lower surface of the upper housing 4 is substantially constant. In other words, the gap in the axial direction between the upper surface of the lower housing 3 and the lower surface of the upper housing 4 is smaller at the region where the connecting portion 44 is formed than at the region where the first curved portion 42 is disposed and the region where the second curved portion 43 is disposed.

In the radial direction, part of the region where the connecting portion 44 is disposed and part of a region where the plurality of first flow straightening plates 23 and the coupling portion 24 are disposed overlap each other. In other words, in a channel in the inside of the fan assembly 20, the plurality of first flow straightening plates 23 and the coupling portion 24 are formed in a region where the static pressure is locally high. Therefore, the occurrence of turbulence is reduced and the blowing efficiency is increased. By reducing turbulence, noise that is produced in the inside of the fan assembly 20 is also reduced. Further, since the plurality of first flow straightening plates 23 and the coupling portion 24 are disposed at a region where the gap in the axial direction between the upper surface of the lower housing 3 and the lower surface of the upper housing 4 becomes small, the lengths of the plurality of first flow straightening plates 23 and the coupling portion 24 in the axial direction can be made small. Therefore, the rigidities of the plurality of first flow straightening plates 23 and the coupling portion 24 are increased, and the amount of material required to form the plurality of first flow straightening plates 23 and the connecting portion 44 can also be reduced, so that costs can be reduced. However, the plurality of first flow straightening plates 23 need not be provided at the region where the connecting portion 44 is disposed. By disposing the plurality of first flow straightening plates 23 at a region where a channel for the air discharged from the fan 21 is small, the same operation effects can be obtained.

Figure 4:
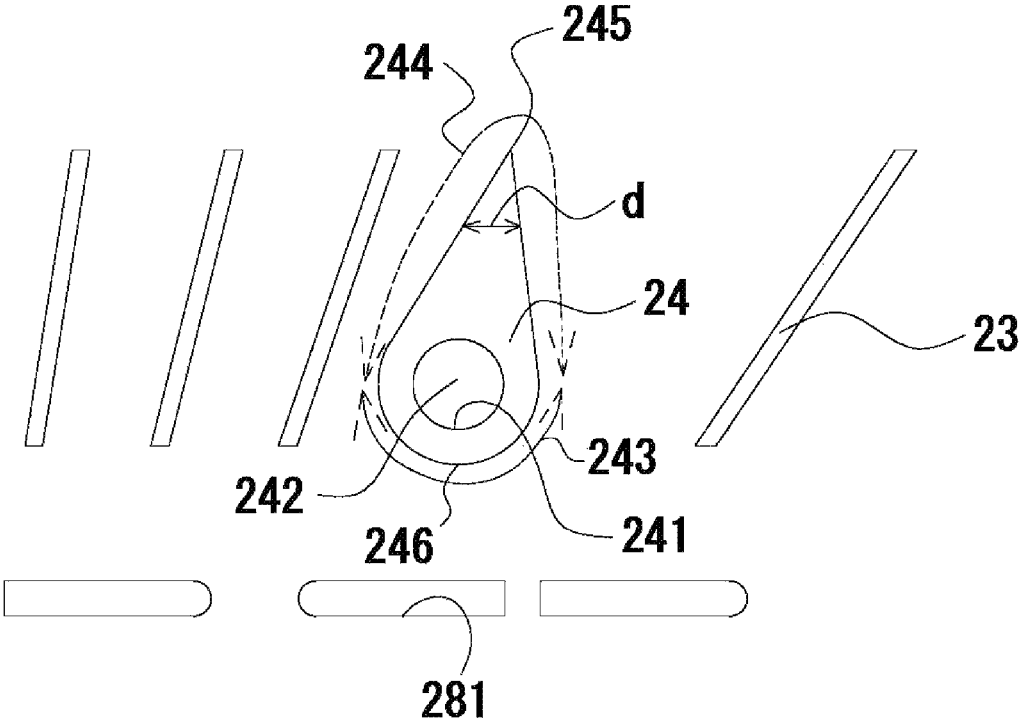
FIG. 4 is an enlarged view of the cross sectional view of the fan assembly of the first embodiment.

FIG. 4 is an enlarged view of the cross sectional view of the coupling portion 24 of the fan assembly 20 of the first embodiment. The coupling portion 24 has a through hole 241 extending in the axial direction. That is, the coupling portion is a hollow portion having the through hole 241. In the embodiment, by inserting a screw into the through hole 241 via the upper housing 4, and securing the screw to a side of the refrigerator interior 10 via the lower housing 3, the fan assembly 20 is secured to the refrigerator interior 10. However, the member that secures the upper housing 4, the lower housing 3, and the refrigerator interior 10 need not be a screw. A fastening member may be selected as appropriate in accordance with a desired fastening strength and size of, for example, the fan assembly 20.

In the embodiment, outer edges of the connecting portion are asymmetrical with reference to a through hole center 242. That is, the coupling portion 24 is not circular. More specifically, an upstream-side outer edge 243 that is disposed closer to the upstream side, where the fan 21 is disposed, than the through hole center 242 has a substantially arc shape. On the other hand, at least one edge portion of a downstream-side outer edge 244 that is disposed closer to the downstream side, where the plurality of first discharge ports 221 are disposed, than the through hole center 242 is substantially parallel to the adjacent first flow straightening plate 23. The coupling portion 24 is formed such that, from the upstream side towards the downstream side, a width d in a direction that is orthogonal to the direction from the upstream side to the downstream side becomes smaller. Further, the distance from the through-hole center 242 to a downstream-side outer edge end 245, which is a downstream end of the downstream-side outer edge 244, is larger than the distance from the through-hole center 242 to an upstream-side outer edge end 246, which is an upstream-side end of the upstream-side outer edge 243.

On the other hand, when the outer edges of the coupling portion are substantially circular, the downstream-side outer edge and the upstream-side outer edge have substantially arc shapes, as a result of which a gap between the adjacent first flow straightening plate 23 and each outer edge is drastically increased. Therefore turbulence tends to occur near the downstream-side outer edge and the upstream-side outer edge. In comparison, the coupling portion 24 of the embodiment is such that only the upstream-side outer edge 243 has a substantially arc shape. Therefore, turbulence that occurs in the air discharged from the fan 21 is reduced, and the blowing efficiency in the inside of the fan assembly 20 is increased. The outer edges of the coupling portion 24 need not have the aforementioned shapes. The coupling portion 24 may have an elliptical shape having a long axis in a direction towards the downstream side with reference to the through hole center 242. For example, the downstream-side outer edge 244 may have a substantially arc shape, and the upstream-side outer edge 243 may extend so as to be substantially parallel to the adjacent first flow straightening plate 23.

Figure 5:
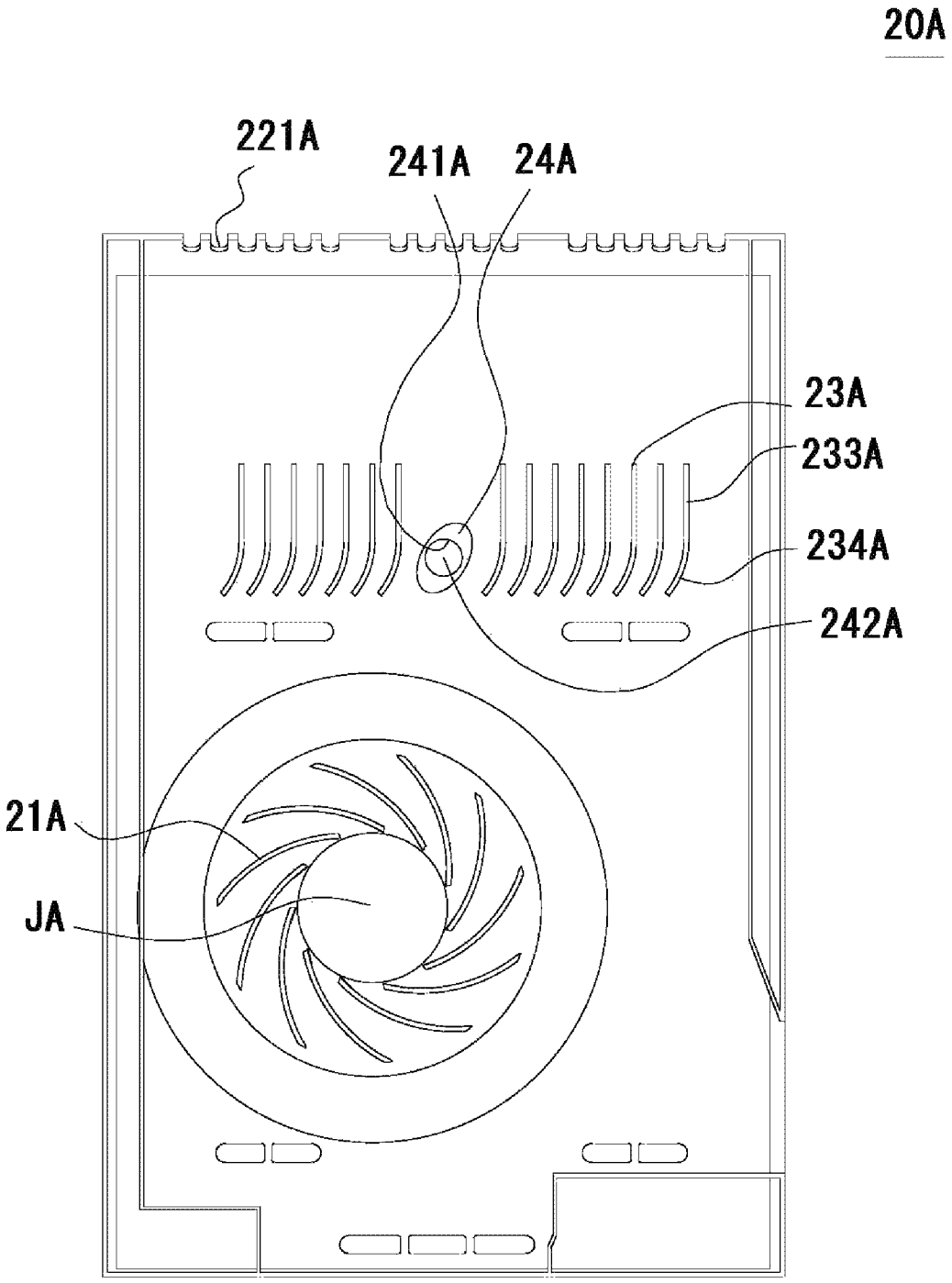
FIG. 5 is a cross sectional view of a fan assembly of a second embodiment.

FIG. 5 is a cross sectional view of a fan assembly 20A of a second embodiment. In FIG. 5, for convenience sake, the first guide wall 271, the second guide wall 272, the third guide wall 273, the fourth guide wall 274, the guiding portion 25, and the partition plate 26, which are shown in the fan assembly 20 of the first embodiment, are not shown.

A plurality of first flow straightening plates 23A are disposed closer to the downstream side than a fan 21A. The first flow straightening plates 23A each include a flat-plate-shaped portion 233A and an arc-shaped portion 234A that is connected to the corresponding flat-plate-shaped portion 233A and that is curved from the downstream side, where a plurality of first discharge ports 221A are disposed, towards the upstream side, where the fan 21A is disposed. This causes part of air discharged from the fan 21A to flow towards the downstream side, to flow along the arc-shaped portions 234A and the flat-plate-shaped portions 233A, and to be guided to the plurality of first discharge ports 221A. Therefore, the blowing efficiency of air discharged from the fan 21A and moving towards the plurality of first discharge ports 221A is increased, and noise that is produced in the inside of the fan assembly 20A is reduced.

A coupling portion 24A has an elliptical shape having a long axis that is substantially parallel to a line connecting a rotation axis JA of the fan 21A and a through hole center 242A of a through hole 241A of the coupling portion 24A. By this, when part of the air discharged from the fan 21A passes near the coupling portion 24A, the resistance force that the air receives from the coupling portion 24A is reduced, and the air flows smoothly along an outer edge of the coupling portion 24A towards the plurality of first discharge ports 221A. Therefore, the blowing efficiency in the inside of the fan assembly 20A is increased, and noise that is produced in the inside of the fan assembly 20A is reduced.

Figure 6:
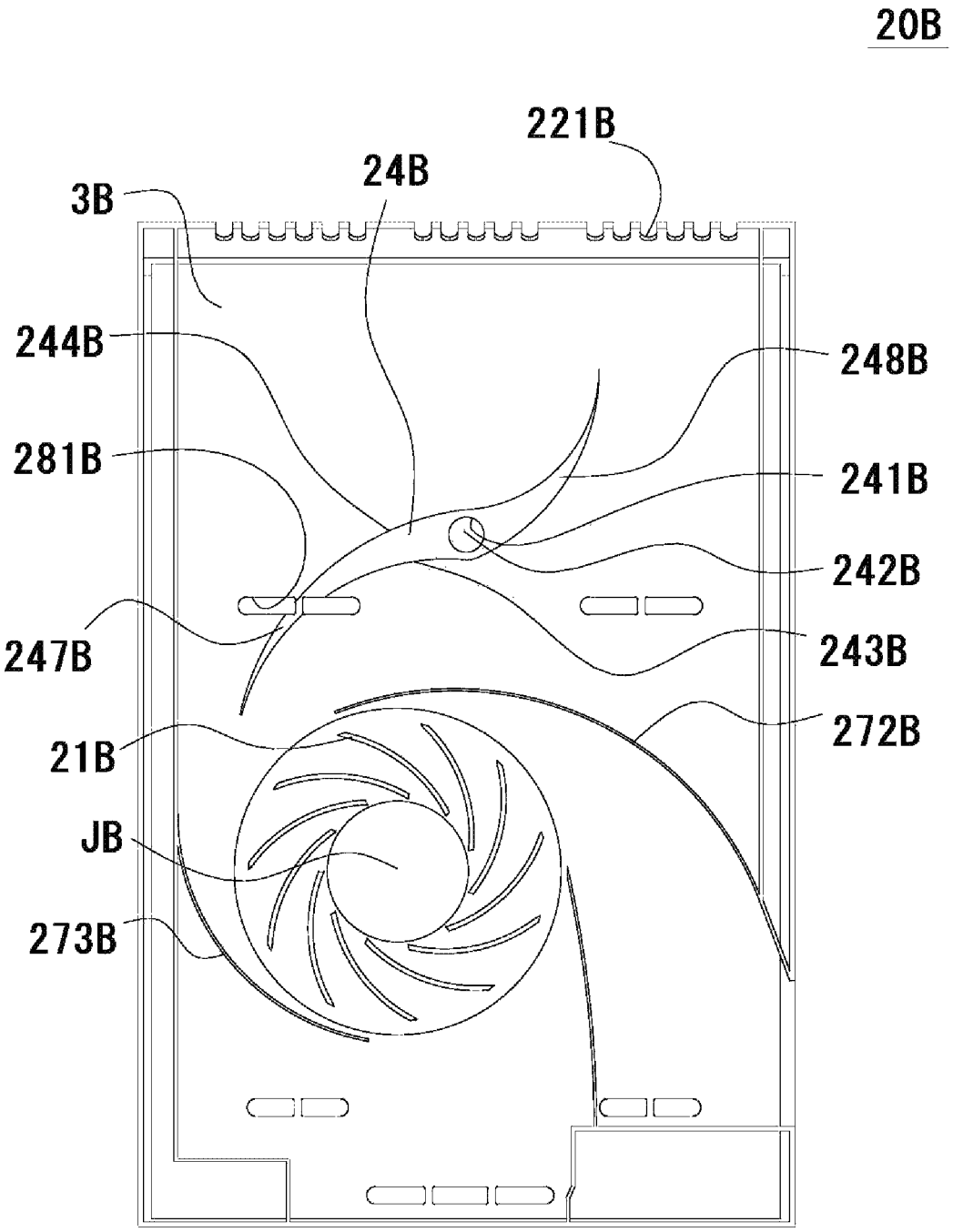
FIG. 6 is a cross sectional view of a fan assembly of a third embodiment.

FIG. 6 is a cross sectional view of a fan assembly 20B of a third embodiment. In FIG. 6, for convenience sake, the first guide wall 271, the fourth guide wall 274, the first flow straightening plates 23, and the guiding portion 25, which are shown in the fan assembly 20 of the first embodiment, are not shown.

In FIG. 6, a plurality of ventilation ports 281B, a coupling portion 24B, and a plurality of first discharge ports 221B are disposed above a fan 21B. In FIG. 6, a second guide wall 272B is disposed from above a fan 21B towards the right of a rotation axis JB.

A coupling portion 24B includes a left curved portion 247B and a right curved portion 248B. With reference to a through hole center 242B, the left curved portion 247B is curved towards the upstream side while forming an arc whose curvature radius center is disposed to the right of the rotation axis JB in FIG. 6. From the downstream side towards the upstream side, the width of the left curved portion 247B in a direction orthogonal to a direction from the downstream side to the upstream side becomes smaller. That is, an upstream-side end portion of the left curved portion 247B is pointed towards the upstream side.

Therefore, when part of air discharged from the fan 21B passes through a gap between the left curved portion 247B and the second guide wall 272B, it flows smoothly without being separated from the left curved portion 247B. Consequently, the blowing efficiency in the inside of the fan assembly 20B is increased, and noise is also reduced. When part of the air discharged from the fan 21B passes through a gap between a third guide wall 273B and the left curved portion 247B, it flows smoothly without being separated from the left curved portion 247B. Consequently, the blowing efficiency in the inside of the fan assembly 20B is increased, and noise is also reduced. Further, when part of the air discharged from the fan 21B collides with the upstream-side end portion of the left curved portion 247B, it does not receive a large resistance force. Therefore, the blowing efficiency in the inside of the fan assembly 20B is increased, and noise is also reduced.

In the embodiment, part of the plurality of first ventilation ports 281B is disposed between the through hole center 242B and the upstream-side end portion of the left curved portion 247B. Therefore, part of the air discharged from the fan 21B is discharged to the outside of the fan assembly 20B via the plurality of first ventilation ports 281B.

With reference to the through hole center 242B, the right curved portion 248B is curved towards the downstream side while forming an arc whose curvature radius center is disposed on the left of the rotation axis JB in FIG. 6. From the upstream side towards the downstream side, the width of the right curved portion 248B in a direction orthogonal to a direction from the upstream side to the downstream side becomes smaller. That is, a downstream-side end portion of the right curved portion 248B is pointed towards the downstream side.

This causes part of the air discharged from the fan 21B to pass through a gap between the right curved portion 248B and the second guide wall 272B, and to flow smoothly towards the plurality of first discharge ports 221B without being separated up to the downstream-side end portion of the right curved portion 248B. Therefore, it is possible to increase the blowing efficiency in the inside of the fan assembly 20B, and also to reduce noise.

The shape of the coupling portion 24B is not limited to that characterized by the left curved portion 247B and the right curved portion 248B as that described above. For example, the coupling portion 24B may be a portion in which the left curved portion 247B and the right curved portion 248B have a plurality of inflection points and curved shapes that are characterized by a plurality of curvature radii are connected to each other.

Figure 7:
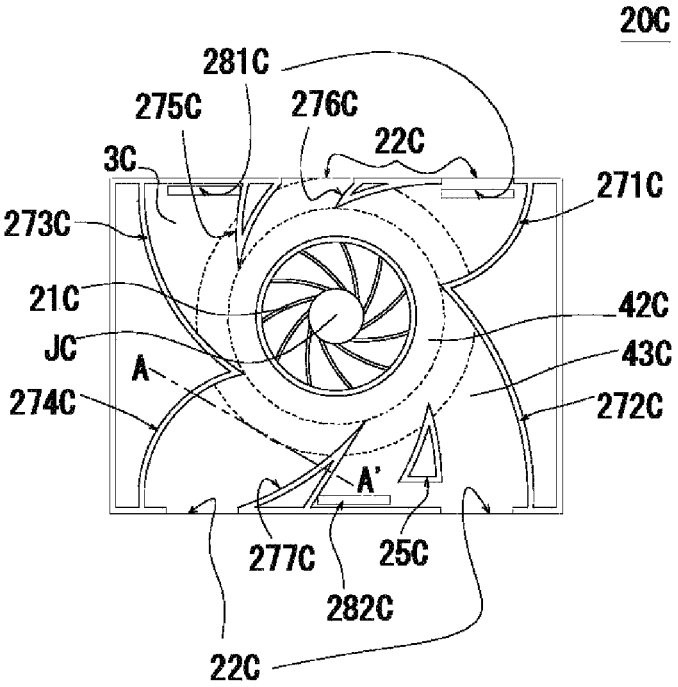
FIG. 7 is a cross sectional view of a fan assembly of a fourth embodiment.
Figure 8:
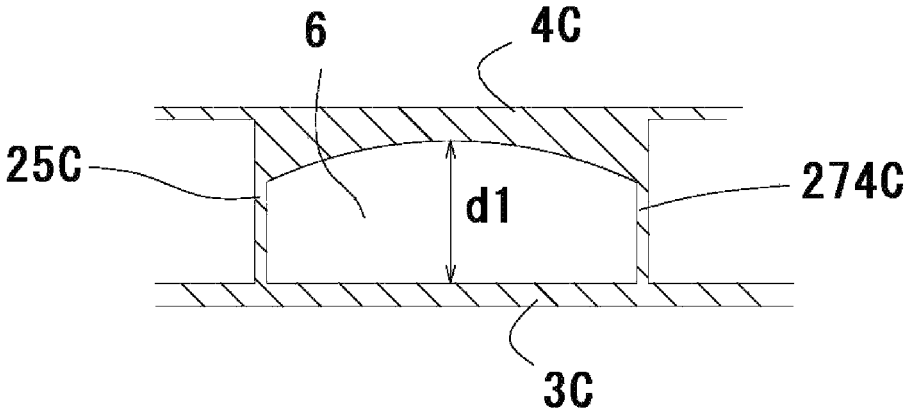
FIG. 8 is a sectional view along A-A' according to the fan assembly of the fourth embodiment.

FIG. 7 is a cross sectional view of a fan assembly 20C of a fourth embodiment. FIG. 8 is a sectional view along A-A' in FIG. 7. This embodiment differs from the first embodiment in guide portions 25C, a plurality of guide walls 27C, a first curved portion 42C, and a second curved portion 43C. The plurality of guide walls 27C include guide walls 271C, 272C, 273C, 274C, 275C, 276C, and 277C. The guide portions 25C and the guide walls 27C are distinguished from each other in that the guide portions 25C are part of a first flow straightening portion that is provided at a lower housing 3, whereas the guide walls 27C are part of a third flow straightening portion that is provided at a side housing 5. However, in the embodiment, the guide portion may be part of a second flow straightening portion that is provided at an upper housing 4, and the guide walls may be a single member with respect to the upper housing 4 or the lower housing 3.

At an outer side in the radial direction with reference to the fan 21C, the first guide wall 271C, the second guide wall 272C, the third guide wall 273C, the fourth guide wall 274C, the guide portions 25C, a plurality of discharge ports 22C, a plurality of first ventilation ports 281C, and a second ventilation port 282C are formed. The first flow straightening portion that is provided at the lower housing 3 extends in the axial direction between the fan 21C and the discharge ports 22C, and includes the guide portions 25C that protrude towards the inside of the fan assembly 20C. The third flow straightening portion that is provided at the side housing 5 includes the plurality of guide walls 27C that protrude towards the inside of the fan assembly 20C. Any one of gaps formed by the plurality of guide walls 27C that are adjacent to each other and gaps formed by the guide walls 27C and the guide portions 25C that are adjacent to each other increases in size from the upstream side, where the fan 21C is disposed, towards the downstream side, where the plurality of discharge ports 22C are disposed.

This causes air discharged from the fan 21C to be smoothly guided to the plurality of discharge ports 22C, the plurality of first ventilation ports 281C, and the second ventilation port 282C while reducing turbulence that is produced in the air discharged from the fan 21C. Therefore, the blowing efficiency in the inside of the fan assembly 20C is increased, and the cooling efficiency of the refrigerator 1 is also increased. At the same time, since the air in the inside of the fan assembly 20C flows smoothly, noise that is produced in the inside of the fan assembly 20C is reduced. Further, outer end portions of the plurality of guide portions 25C in the radial direction are adjacent to the plurality of discharge ports 22C, the plurality of first ventilation ports 281C, and the second ventilation port 282C. Therefore, part of air that is discharged from the fan 21C is smoothly guided to the plurality of discharge ports 22C, the plurality of first ventilation ports 281C, and the second ventilation port 282C. As a result, the blowing efficiency in the inside of the fan assembly 20C is increased, and the cooling efficiency of the refrigerator 1 is increased.

Broken lines in FIG. 7 indicate a boundary between the first curved portion 42C and the connecting portion 44 indicated in FIG. 3 and a boundary between the second curved portion and the connecting portion 44. In the embodiment, at least one of the boundary between the first curved portion 42C and the connecting portion 44 and the boundary between the second curved portion and the connecting portion 44 is substantially concentrically disposed around a rotation axis JC as a center. Therefore, even if the fan assembly 20C is relatively small compared to the fan 21C, air can be discharged with variations in the air volume towards the discharge ports 22C or the first ventilation ports 281C being reduced. Consequently, the blowing efficiency can be increased.

FIG. 8 is a sectional view along A-A' in FIG. 7. A channel 6 is formed by an inner surface of the fourth guide wall 274C, an inner surface of the guide portion 25C, the lower housing 3C, and the upper housing 4C. A lower surface of the upper housing 4C gradually inclines downward from the center of the channel 6 towards the fourth guide wall 274C and the guide portion 25C. That is, a gap in the axial direction between the lower surface of the upper housing 4C and an upper surface of the lower housing 3C is largest near the center of the channel 6. In other words, the upper housing 4, the lower housing 3, and the side housing 5, or the upper housing 4 and the lower housing 3 form part of the channel 6. In a section where the channel 6 is viewed from the upstream side, where the fan 21C is disposed, towards the downstream side, where the plurality of discharge ports 22C are disposed, a gap d1 in the axial direction at the center of the channel 6 is the largest.

Here, fluids including air have viscosity. Fluid at the center of the channel flows easily, whereas fluid at the corners of the channel have difficulty flowing. When there are portions in the channel where fluid has difficulty flowing, this may cause turbulence. Therefore, in the embodiment, a gap in the axial direction near the center of the channel where the fluid flows easily is large, and a gap in the axial direction near the corners of the channel where the fluid has difficulty flowing is small. Therefore, turbulence is less likely to occur, and the air can flow efficiently. Consequently, the blowing efficiency can be increased.

Figure 9:
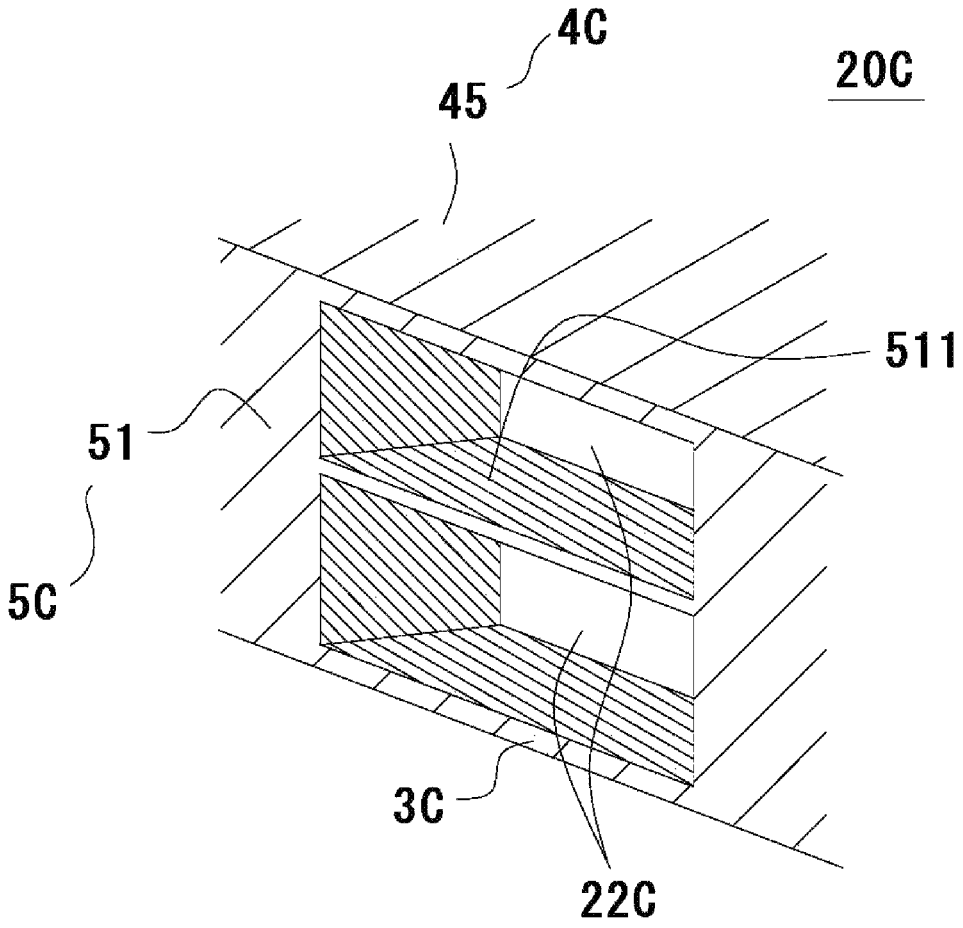
FIG. 9 is a partial enlarged view of the vicinity of discharge ports of the fan assembly of the fourth embodiment.

FIG. 9 is a partial enlarged view of the vicinity of the plurality of discharge ports 22C when viewed from the outside of the fan assembly 20C. The side housing 5C includes a wall portion 51 that extends downward in the axial direction from an outer edge of a planar surface 45, which is an upper surface of the upper housing 4C in the axial direction. The plurality of discharge ports 22C are formed by the wall portion 51, the upper housing 4C, and the lower housing 3C. At the center of the plurality of discharge ports 22C in the axial direction, the wall portion 51 of the side housing 5C includes a plate-shaped second flow straightening plate 511 extending from the inside to the outside of the fan assembly 20C. The second flow straightening plate 511 is part of the third flow straightening portion that is provided at the side housing 5C. This causes part of air that is discharged from the discharge ports 22C to be discharged along the second flow straightening plate 511. Therefore, it is possible to reduce a case in which part of the air that is discharged from the discharge ports 22C is discharged by being veered upward and downward in the axial direction from the fan assembly 20C. That is, since part of the air that is discharged from the discharge ports 22C is smoothly guided to an outer side in the radial direction, the blowing efficiency and the discharge air volume to the outer side in the radial direction are increased. Since the second curved portion 43 of the upper housing 4 is curved upward in the axial direction towards the outer side in the radial direction, part of the air that is discharged from the discharge ports 22C has a high tendency to be discharged by being veered upward in the axial direction from the fan assembly 20C. Therefore, when the second flow straightening plate 511 is disposed on an upper side in the axial direction from the center of the fan assembly 20C in the axial direction, it is possible to reduce the amount of air that is veered to the upper side in the axial direction and to further increase blowing efficiency. The number of second flow straightening plates 511 need not be one, and may be two or more.

Figure 10:
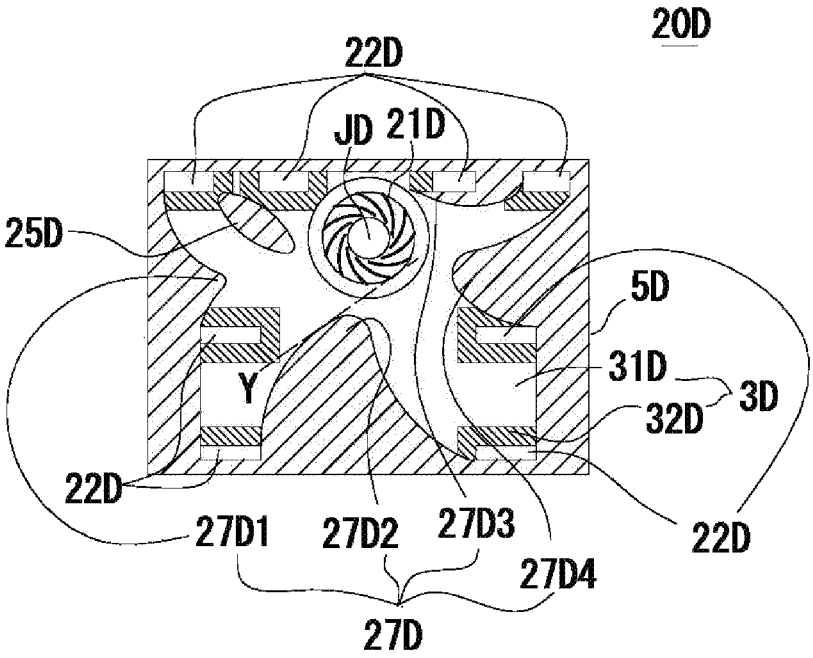
FIG. 10 is a cross sectional view of a fan assembly of a fifth embodiment.

FIG. 10 is a cross sectional view of a fan assembly 20D of a fifth embodiment. A lower housing 3D includes a plurality of discharge ports 22D that open downward in the axial direction. In this embodiment, there are eight discharge ports 22D.

A base portion 31D of the lower housing 3D includes a plurality of inclined surfaces 32D. Each inclined surface 32D is a portion that extends obliquely rightward and downward and that is hatched. At the vicinity of a plurality of discharge ports 22D, the inclined surfaces 32D are surfaces that are inclined downward in the axial direction from the base portion 31D of the lower housing 3D towards the discharge ports 22D. This causes air that is discharged from a fan 21D to be smoothly discharged to the outside of the fan assembly 20D. Each inclined surface 32D may be an inclined surface that extends linearly, or may be a protruding curved surface that protrudes towards a channel in the inside of the fan assembly 20D.

A first flow straightening portion that is provided at the lower housing 3D extends in the axial direction between the fan 21D and the plurality of discharge ports 22D and includes a guide portion 25D that protrudes towards the inside of the fan assembly 20D. A third flow straightening portion that is provided at a side housing 5D includes a plurality of guide walls 27D that protrude towards the inside of the fan assembly 20D. The plurality of guide walls 27D include protruding portions 27D1, 27D2, 27D3, and 27D4 that protrude towards the fan 21D. An end of each of the plurality of protruding portions 27D1, 27D2, 27D3, and 27D4 has a substantially arc shape. This causes the air that is discharged from the fan 21D to be smoothly guided without be being separated at each of the protruding portions 27D1, 27D2, 27D3, and 27D4.

A front surface in a rotation direction of the fan 21D of each of the guide portion 25D and the protruding portions 27D1, 27D2, 27D3, and 27D4 that are adjacent to the fan 21D is a protruding curved surface that protrudes towards the front in the rotation direction of the fan 21D. Part of each curved surface contacts part of a tangent to the fan 21D. For convenience sake, only a tangent Y where part of the fan 21D and the curved surface of the protruding portion 27D2 contact each other is shown by a broken line. This causes part of the air that is discharged from the fan 21D to be smoothly guided along the curved surfaces towards the plurality of discharge ports 22D, and the blowing efficiency to be increased.

Further, in a channel that is formed by an upper housing 4, the lower housing 3D, the guide portion 25D, and the plurality of guide walls 27D, the sectional area of a portion of the channel that is connected to the discharge ports 22D whose distance from the fan 21D is large is larger than the sectional area of a portion of the channel that is connected to the discharge ports 22D whose distance from the fan 21D is small. Therefore, it is possible to discharge air uniformly to the plurality of discharge ports 22D and to reduce variations in the air volume that is discharged from the plurality of discharge ports 22D. Consequently, it is possible to reduce noise that is produced from the fan assembly 20D.

Figure 11:
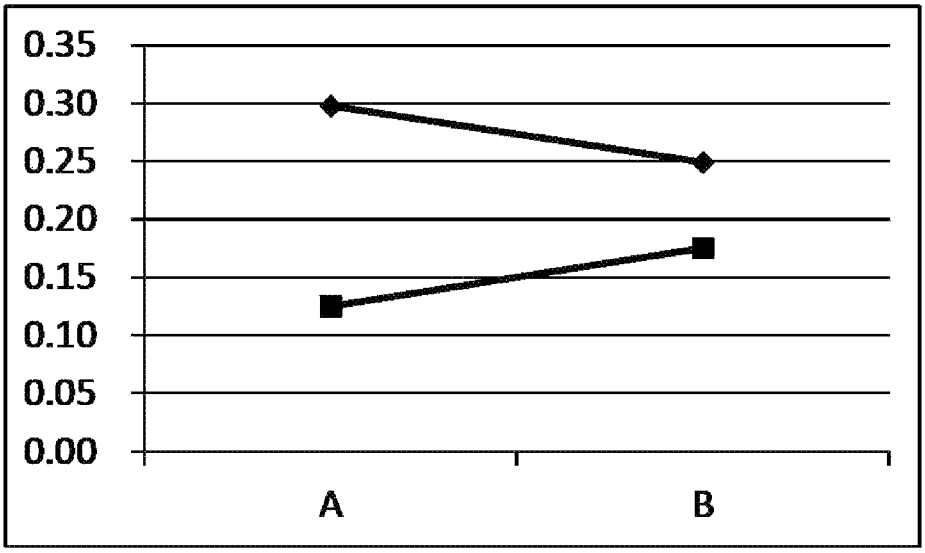
FIG. 11 shows air volume characteristics of the fan assembly of the fifth embodiment.

FIG. 11 shows air volume characteristics of the fan assembly 20D of this embodiment. The vertical axis indicates air volumes. The vertical axis only indicates the air volume at the discharge port 22D where the air volume is the largest and the air volume at the discharge port 22D where the air volume is the smallest among the air volumes of eight discharge ports 22D. The horizontal axis indicates a fan assembly before an improvement A and the fan assembly 20D after the improvement B. The fan assembly before the improvement A and the fan assembly 20D after the improvement B are the same in the dispositions of the fan and the plurality of discharge ports; and differ, as described above, in terms of the improvements that are made as appropriate on the shapes of the lower housing, the upper housing, and the side housing. Accordingly, the air volume of the fan assembly before the improvement A is such that the difference between the maximum air volume and the minimum air volume is approximately 0.175 ($m^3$/min), whereas the air volume of the fan assembly 20D after the improvement B is such that the difference between the maximum air volume and the minimum air volume is reduced to approximately 0.075 ($m^3$/min). Accordingly, the numerical data shows the effects of the embodiment in which the shapes of the lower housing, the upper housing, and the side housing are improved as appropriate.

Figure 12:
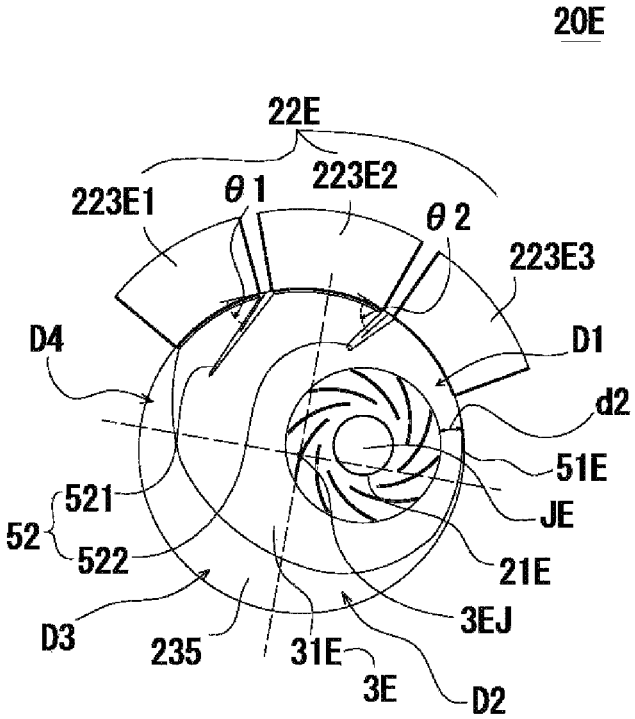
FIG. 12 is a cross sectional view of a fan assembly of a sixth embodiment.

FIG. 12 is a cross sectional view of a fan assembly 20E of a sixth embodiment. A lower housing 3E includes a substantially circular base portion 31E and a plurality of discharge ports 22E that are disposed outward in the radial direction from an outer edge of the base portion 31E. A fan 21E is disposed on the base portion 31E. An outer side of the fan 21E in the radial direction is covered by a wall portion 51E of a side housing 5 and a side wall portion 235 of the lower housing 3E described below. The base portion 31E may be elliptical instead of being circular.

The discharge ports 22E include a plurality of third discharge ports. The plurality of third discharge ports include three third discharge ports 223E1, 223E2, and 223E3 in that order from the left of FIG. 11. The central angles of the plurality of third discharge ports 223E1, 223E2, and 223E3 with reference to a center 3DJ of the base portion 31E are substantially the same. More specifically, the central angle of the third discharge port 223E1 and the central angle of the third discharge port 223E3 are equal to each other, and are less than the central angle of the third discharge port 223E2. However, the central angles can be changed as appropriate in accordance with the structure of the inside of the refrigerator 1.

In the embodiment, the air volumes that are discharged from the plurality of discharge ports 22E are such that the air volume that is discharged from the third discharge port 223E2 is the largest, and the air volume that is discharged from the third discharge port 223E1 is the smallest. More specifically, the ratio of the air volumes of the third discharge port 223E1, the third discharge port 223E2, and the third discharge port 223E3 is approximately 2:5:3. However, the ratio of the air volumes can be changed as appropriate in accordance with the structure of the inside of the refrigerator 1.

Here, when the fan 21E is disposed such that a rotation axis JE of the fan 21E and a center 3EJ of the base portion 31E simply overlap each other, the aforementioned air volume ratio cannot be satisfied. This is because the air volume ratio is calculated based on various parameters, such as the rotation direction of the fan 21E, the relationship between the dispositions of the fan 21E and the plurality of discharge ports 22E, and the shape of the base portion 31E, which influence each other.

Here, in the embodiment, the rotation axis JE of the fan 21E is displaced from the center 3EJ of the base portion 31E. More specifically, the rotation axis JE of the fan 21E is disposed within a region D1 among four regions D1, D2, D3, and D4 that are on the base portion 31E and that are separated by a line connecting the center 3EJ of the base portion 31E and the center of the discharge ports 22E in the peripheral direction and by a perpendicular line to the line passing through the center of the base portion 31E. The region D1 is adjacent to the third discharge port 223E3 disposed on a frontmost side in the rotation direction of the fan 21E. The rotation direction of the fan 21E is clockwise in FIG. 11. In this way, in this embodiment, since the rotation direction of the fan 21E and the relationship between the dispositions of the fan 21E and the plurality of discharge ports 22E are considered, it is easy to realize the air volume ratio that is desired.

The base portion 31E includes a plurality of third flow straightening plates 52 that, on the base portion 31E, extend from portions of the outer edge of the base portion 31E that are between adjacent ones of the plurality of discharge ports 22E to a side in a direction opposite to the rotation direction of the fan 21E. More specifically, the plurality of third flow straightening plates 52 include a third flow straightening plate 521 that extends from a portion between the third discharge port 223E1 and the third discharge port 223E2 to a side in a direction opposite to the rotation direction of the fan 21E and a third flow straightening plate 522 that extends from a portion between the third discharge port 223E2 and the third discharge port 223E3 to a side in a direction opposite to the rotation direction of the fan 21E. Therefore, the rotation direction of the fan 21E, the relationship between the dispositions of the fan 21E and the plurality of discharge ports 22E, and further the shape of the base portion 31E are considered, so that the air volume ratio that is desired is more easily realized. At the outer edge of the base portion 31E, angles θ1 and θ2 between tangents to the plurality of third flow straightening plates 52 and directions of extensions of the plurality of third flow straightening plates 52 are acute angles. The extending directions and the lengths of the plurality of third flow straightening plates 52 can be changed as appropriate in accordance with the desired air volume ratio. That is, it is possible to provide a general-purpose product.

The base portion 31E further includes the substantially arc-shaped side wall portion 235 that protrudes in the axial direction. A portion of the side wall portion 235 that is thickest in the radial direction is disposed in the region D3. In other words, the thickest portion of the side wall portion 235 in the radial direction is disposed in the region D3 that is opposite to the region D1, where the rotation axis JE of the fan 21E is disposed, with reference to the center 3EJ of the base portion 31E. Here, among the regions D1, D2, D3, and D4, the region D3, which is a space that is farthest from the fan 21E, includes a lot of space portions that have difficulty contributing to an increase the air volume. Therefore, in order to increase the air volume of air that is discharged from the plurality of discharge ports 22E, the space of the region D3 needs to be small. In the embodiment, since the thickest portion of the side wall portion 235 in the radial direction is disposed in the region D3, the space of the region D3 can be made small. Therefore, it is possible to increase the air volume of the air that is discharged from the plurality of discharge ports 22E. The region in which the side wall portion 235 is disposed and the thickness of the side wall portion 235 can be changed as appropriate in accordance with the size of the fan 21E and the size of the base portion 31E. That is, it is possible to provide a general-purpose product.

Further, it is desirable to set the curvature of the wall portion 51E of the side housing 5 and the curvature of the side wall portion 235 of the lower housing 3E as appropriate such that a gap between the fan 21E and the side wall 51E of the side housing 5 and that between the fan 21E and the side wall portion 235 of the lower housing 3E become gradually larger at a certain ratio from a smallest gap d2. This causes the static pressure in the inside of the fan assembly 20E to change smoothly, so that the blowing efficiency in the inside of the fan assembly 20E is increased, and the cooling efficiency of the refrigerator 1 is increased.

The fan assemblies of the first embodiment to the sixth embodiment described above may be used in any devices. For example, although they are used for refrigerator fan assemblies, the use thereof is not limited thereto. They may be used in, for example, freezers, ovens, microwave ovens, and other cooking appliances; and televisions, desktop personal computers, notebook-size personal computers, and other home appliances.

The structures described in the above-described first embodiment to the sixth embodiment may be combined as appropriate within a scope that does not cause mutual contradiction.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A fan assembly for a refrigerator interior, comprising:

a lower housing where a fan that rotates around a rotation axis as a center is installed, the rotation axis extending in an up-down direction;

an upper housing that includes an inlet that suctions air from the refrigerator interior; and a side housing that covers a surrounding portion of the fan, wherein any one of the upper housing, the lower housing, and the side housing includes a flow straightening member that straightens a flow of air that is discharged from the fan, the lower housing includes:

a base portion having a circular shape, and a plurality of the discharge ports that are at an outer edge of the base portion, the rotation axis of the fan is within one region among four regions that are on the base portion and that are separated by a first line connecting a center of the base portion and a center of the plurality of discharge ports in a peripheral direction and a second line perpendicular to the first line and passing through the center of the base portion, the one region being adjacent to one of the plurality of the discharge ports that is on a frontmost side in a rotation direction of the fan, an edge of the one of the plurality of the discharge ports on the frontmost side in the rotation direction of the fan is in the one region, the base portion includes an arc-shaped side wall portion that protrudes in an axial direction, and a portion of the side wall portion that is thickest in a radial direction is disposed in a region that is opposite to the one region where the rotation axis of the fan is disposed with reference to the center of the base portion.

2. The fan assembly according to claim 1, wherein the flow straightening member includes a first flow straightening portion that is provided at the lower housing, and wherein the first flow straightening portion includes a plurality of first flow straightening plates extending in the axial direction between the fan and the discharge port.

3. The fan assembly according to claim 2, wherein the plurality of first flow straightening plates are disposed with a gap therebetween, and wherein a width of the gap increases from an upstream side, where the fan is disposed, towards a downstream side, where the discharge port is disposed.

4. The fan assembly according to claim 2, wherein the plurality of first flow straightening plates each include a flat-plate-shaped portion, and an arc-shaped portion that is connected to a corresponding one of the flat-plate-shaped portions and that is curved from a downstream side, where the discharge port is disposed, towards an upstream side, where the fan is disposed.

5. The fan assembly according to claim 2, wherein the first flow straightening portion includes a coupling portion that is disposed in a region where a gap in the axial direction between an upper surface of the lower housing and a lower surface of the upper housing becomes small, and that couples the upper housing and the lower housing.

6. The fan assembly according to claim 5, wherein from an upstream side, where the fan is disposed, towards a downstream side, where the discharge port is disposed, a width of the coupling portion in a direction that is orthogonal to a direction from the upstream side to the downstream side becomes smaller.

7. The fan assembly according to claim 5, wherein the coupling portion includes a through hole that extends in the axial direction, an upstream-side outer edge that is disposed closer to an upstream side than a center of the through hole, and a downstream-side outer edge that is disposed closer to a downstream side than the center of the through hole, and wherein the upstream-side outer edge has an arc shape when viewed from the axial direction, and at least one edge portion of the downstream-side outer edge is parallel to the first flow straightening plate adjacent thereto.

8. The fan assembly according to claim 5, wherein the coupling portion includes a through hole that extends in the axial direction, an upstream-side outer edge that is disposed closer to an upstream side than a center of the through hole, and a downstream-side outer edge that is disposed closer to a downstream side than the center of the through hole, an upstream-side outer edge end, which is an upstream-side end of the upstream-side outer edge, and a downstream-side outer edge end, which is a downstream end of the downstream-side outer edge, wherein a distance from the center of the through hole to the downstream-side outer edge end is larger than a distance from the center of the through hole to the upstream-side outer edge end.

9. The fan assembly according to claim 5, wherein the coupling portion includes a through hole that extends in the axial direction, a left curved portion that is curved towards an upstream side, where the fan is disposed, with reference to a center of the through hole, and a right curved portion that is curved towards a downstream side, where the discharge port is disposed, with reference to the center of the through hole, wherein from the downstream side towards the upstream side, a width of the left curved portion in a direction orthogonal to a direction from the downstream side to the upstream side becomes smaller, and from the upstream side towards the downstream side, a width of the right curved portion in a direction orthogonal to a direction from the upstream side to the downstream side becomes smaller.

10. The fan assembly according to claim 1, wherein the flow straightening member includes a second flow straightening portion that is provided at the upper housing, wherein the second flow straightening portion protrudes downward in the axial direction from a lower surface of the upper housing and includes a first curved portion whose thickness in the axial direction increases from an upstream side, where the fan is disposed, towards a downstream side, where the discharge port is disposed, and a second curved portion whose thickness in the axial direction decreases from the upstream side towards the downstream side at a location that is closer to the downstream side than the first curved portion.

11. The fan assembly according to claim 10, wherein the first curved portion extends from a lower end of the inlet towards the downstream side, where the discharge port is disposed.

12. The fan assembly according to claim 10, wherein the first curved portion and the second curved portion are connected by a connecting portion whose thickness in the axial direction is substantially constant, and wherein at least one of a boundary between the first curved portion and the connecting portion and a boundary between the second curved portion and the connecting portion is substantially concentrically disposed around the rotation axis of the fan as the center.

13. The fan assembly according to claim 1, wherein an upper surface of the upper housing has a planar surface extending in a direction orthogonal to the rotation axis, and wherein a lower end of the inlet is disposed above the planar surface in the axial direction.

14. The fan assembly according to claim 1, wherein a first flow straightening portion extends in the axial direction between the fan and the discharge port, and includes a guide portion that protrudes towards an inside of the fan assembly, wherein the flow straightening member includes a third flow straightening portion that is provided at the side housing, wherein the third flow straightening portion includes a plurality of guide walls that protrude towards the inside of the fan assembly, and wherein any one of a gap formed by the guide walls that are adjacent to each other and a gap formed by the guide portion and the guide wall that are adjacent to each other increases in size from an upstream side, where the fan is disposed, towards a downstream side, where the discharge port is disposed.

15. The fan assembly according to claim 14, wherein the side housing includes the discharge port, and wherein at a location that is substantially at a center of the discharge port in the axial direction, the third flow straightening portion includes a plate-shaped second flow straightening plate extending from the inside to an outside of the fan assembly.

16. The fan assembly according to claim 1, wherein the upper housing, the lower housing, and the side housing, or the upper housing and the lower housing form part of a channel, and wherein in a section where the channel is viewed from an upstream side, where the fan is disposed, towards a downstream side, where the discharge port is disposed, a gap in the axial direction at a center of the channel is largest.

17. The fan assembly according to claim 1, wherein the base portion includes a third flow straightening plate that, on the base portion, extends from a portion of the outer edge of the base portion that is between adjacent ones of the discharge ports to a side in a direction opposite to the rotation direction of the fan.

18. The fan assembly according to claim 1, wherein the rotation axis of the fan is within only the one region among four regions that are on the base portion.

19. The fan assembly according to claim 18, wherein a radially innermost edge of another one the plurality of discharge ports on a rearmost side in the rotation direction of the fan is arranged at least partially outside of the one region.

* * * * *